United States Patent [19]

Hofferbert, Jr. et al.

[11] 4,227,885

[45] Oct. 14, 1980

[54] SOLUTION ANNEALING OF ARAMID AND STRUCTURALLY RELATED FIBERS

[75] Inventors: William L. Hofferbert, Jr., Durham; Jack Preston, Raleigh, both of N.C.

[73] Assignee: Monsanto Company, St. Louis, Mo.

[21] Appl. No.: 957,625

[22] Filed: Nov. 3, 1978

[51] Int. Cl.[2] ..... D06P 3/24

[52] U.S. Cl. ..... 8/925; 8/925; 264/184; 264/234; 264/235; 525/410; 525/419; 525/420

[58] Field of Search ..... 8/178 R, 178 A; 264/234, 235, 184; 528/333; 525/410, 419, 420

[56] References Cited

U.S. PATENT DOCUMENTS

| | | | |
|---|---|---|---|
| 3,771,949 | 11/1973 | Hermes | 8/4 |
| 3,796,693 | 4/1974 | Morgan et al. | 260/30.2 |
| 4,115,503 | 9/1978 | Bach | 264/233 |

OTHER PUBLICATIONS

Tincher et al., Protection of Nomex from Ultraviolet Degradation, AD-A041494, Mar. 1977, U.S. Dept. Commerce National Technical Information Service, (pp. 1 to 141).

*Primary Examiner*—Melvyn I. Marquis
*Attorney, Agent, or Firm*—John W. Whisler

[57] ABSTRACT

A process for improving tensile properties of aramid fibers and structurally related fibers is described. The process involves soaking the fibers in a liquid tertiary amine maintained at a temperature of at least 80° C.

9 Claims, No Drawings

SOLUTION ANNEALING OF ARAMID AND STRUCTURALLY RELATED FIBERS

BACKGROUND OF THE INVENTION

A. Field of the Invention

This invention relates to a process for improving tensile properties of aramid fibers and structurally related fibers by soaking the fibers in a tertiary amine (e.g. pyridine) maintained at a temperature of at least 80° C.

The term "aramid" as used herein has its usual meaning which is "a manufactured fiber in which the fiber-forming substance is a long-chain synthetic aromatic polyamide in which at least 85% of the amine linkages are attached directly to two aromatic linkages". The term "structurally related fibers" when used herein with reference to aramid fibers means a modified aramid fiber in which at least a portion of the amide linkages are replaced by hydrazide linkages

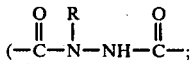

R=H or $C_1$ to $C_4$ alkyl) and/or oxadiazole linkages

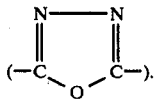

The term "fiber" as used herein means a yarn composed of short fibers (staple) or one or more filaments.

B. Description of the Prior Art

Aramid fibers, such as those prepared from poly-(m-phenyleneisophthalamide) (i.e. MPD-I) have gained acceptance in recent years because of their excellent resistance to burning and their low generation of smoke when forced to burn, particularly, in applications such as garments for use by firemen, foundry workers, race car drivers, etc. and for drapes and carpets in hospitals and aboard ships and aircrafts. On the other hand, aramid fibers, such as those prepared from poly(p-phenylene terephthalamide) (i.e. PPD-T), and structurally related fibers such as, fibers of the polyterephthalamide of p-aminobenzhydrazide (i.e. BABH-T) and fibers of p-phenylene oxadiazole/p-phenylene N-methylhydrazide copolymer (i.e. OCH), have gained acceptance where high strength is desired, such as, for tire yarn and in composites. Even though aramid fibers have gained acceptance, nevertheless, there is a need to improve the tensile properties of these fibers. In the case of MPD-I type fibers there is a need to reduce its wide range of alongation-to-break values (Eb). A wide range of Eb values leads not only to shrinkage problems when fabrics made from the fibers are laundered, but also to pilling and fuzzing properties of such fabrics. In the case of PPD-T, BABH-T, and OCH fibers it would be desirable to further increase the tensile properties thereof and thereby provide yet a higher strength fiber and higher modulus fiber, especially, if this can be accomplished without loss of elongation-to-break, i.e., with preservation of toughness.

Accordingly, it is an object of the present invention to provide a simple, economical process for improving the tensile properties of aramid fibers and structurally related fibers.

SUMMARY OF THE INVENTION

The foregoing object is accomplished by the process of the present invention which comprises treating aramid fibers in a liquid tertiary amine bath maintained at a temperature between 80° C. and 200° C.

The process of this invention is relatively inexpensive and simple in its operation, in that, a single component may be utilized which is subsequently easily removed from the fiber by washing the fiber with water.

DETAILED DESCRIPTION OF THE PREFERRED EMBODIMENTS

Examples of aramid fibers which can be treated according to the process of this invention to increase their tensile strength include those prepared from aramid polymers having repeating units of the formulas

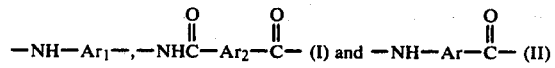

where $Ar_1$, $Ar_2$ and $Ar_3$ are divalent aromatic radicals and may be the same or different from unit to units. Aramid fibers of particular commercial interest are those prepared from poly(m-phenylene isophthalamide) where $Ar_1$ and $Ar_2$ are

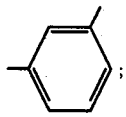

poly(p-phenylene terephthalamide) where $Ar_1$ and $Ar_2$ are

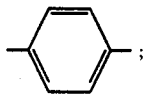

and poly(4,4'-methylenediphenyl isophthalamide) where $Ar_1$ is

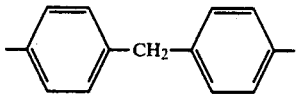

and $Ar_2$ is

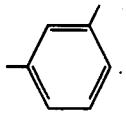

Examples of modified aramide fibers (i.e. structurally related fibers) which can be treated according to the process of this invention to increase their tensile strength include the wholly aromatic amide-hydrazide copolymeric fibers described in U.S. Pat. No. 3,796,693 (e.g. BABH-T fibers) and the wholly aromatic oxadiazole-N-alkylhydrazide copolymeric fibers described in U.S. Pat. No. 4,115,503 (e.g. OHC fibers).

Accordingly, the disclosures of these patents are incorporated herein by reference.

In accordance with the invention aramid fibers and structurally related fibers are treated, preferably, by soaking the fibers in a hot (80°–200° C.) liquid tertiary amine bath for a period of time sufficient to improve the tensile properties of the fibers. The tertiary amine may be pyridine, a derivative thereof (e.g. quinoline), morpholine, triethylamine and the like and mixtures thereof. Pyridine is a particularly preferred tertiary amine because it is highly soluble in water and, therefore, can be easily washed from the fibers after drying. Preferably, the fibers are soaked in a tertiary amine bath maintained at atmospheric pressure and at a temperature at which improvement in the tensile properties is attained within a reasonable time without boiling the liquid, for example, in the case of pyridine at atmospheric pressure and a temperature just below its boiling point, i.e., at a temperature ranging from 100° C. to 115° C. Under these conditions noticeable improvement in the tensile properties is attained in 30 to 60 seconds, although longer periods of time may be employed. The tertiary amine should be at a temperature of at least 80° C. so as to attain good penetration of the annealing media (e.g. pyridine) within a reasonable time but not so high as to cause deterioration of fiber properties (e.g. <200° C.). One distinct advantage of the process is that superatmospheric pressures are not usually required, although such pressures may be beneficially used in the case of all para-oriented fibers where penetration of the annealing media (e.g. pyridine) into the fibers is slow.

The process of this invention may be carried out with dyed or undyed fibers. When the fibers are to be dyed, the process may be carried out simultaneously with dyeing by merely adding an appropriate dye to the liquid tertiary amine bath. Moreover, where incorporation of materials such as stabilizers into the fibers is desired such materials may be added to the tertiary amine bath in addition to or instead of dye(s).

The length of the soaking period is not critical. Accordingly, the soaking may be carried out for from 10 seconds to 24 hours while the liquid is maintained at temperatures ranging from 80°–150° C. and, preferably, at temperatures ranging from 100°–150° C. at atmospheric or superatmospheric pressures. Prolonged soaking of the fiber, for example, poly(m-phenylene isophthalamide) fiber in pyridine is not detrimental.

The following examples are given to further illustrate the invention.

In the example the following abbreviations are used:

MDA-I is poly(4,4'-methylenediphenyl isophthalamide)

MPD-I is poly(m-phenylene isophthalamide)

PPD-T is poly(p-phenylene terephthalamide)

PABH-T is the polyterephthalamide of p-aminobenzhydrazide

EXAMPLE 1

Two examples (Sample A and Sample B) of MDA-I fibers are soaked for 16 hours in pyridine at room temperature and then in boiling pyridine for 2 hours. The samples were then removed from the pyridine, washed in hot tap water and dried at 110° C. Sample A was in as-spun sample while sample B was a hot-drawn sample. Both samples were annealed by the pyridine. The as-spun sample was slightly more effected by the treatment in pyridine than the hot-drawn sample. The elongation-to-break in % (E), the tenacity in grams per denier (T) and initial modulus in grams per denier (Mi) of the samples were measured and are given in Table I.

TABLE I

| | T/E/Mi | Denier |
|---|---|---|
| Sample A | 2.8/28.7/46 | 13.6 |
| after blank dyeing | 2.4/64.2/32 | 17.1 |
| Sample B | 2.7/64.2/32 | 14.1 |
| after blank dyeing | 2.4/50.4/32 | 16.2 |

The above results demonstrate that hot-drawing of the fiber does not prevent opening up of the fiber structure by the pyridine.

EXAMPLE 2

In this example a 10 denier per filament MPD-I fiber sample (Nomex E-19) obtained commercially was treated and tested as in Example 1. The tenacity of the fiber decreased from 2.0 to 1.7 gpd showing the effects of annealing in pyridine. The fiber before annealing in pyridine showed a very wide range of elongation-to-break values, whereas the annealed fiber showed a relatively narrow range of elongation-to-break (41% on the average). Thus, the annealing of aramid fibers should stabilize fabrics made therefrom against subsequent shrinkage during laundering and cleaning and should reduce the pilling and fuzzing propensity of such fabrics.

EXAMPLE 3

A sample of PPD-T was treated and tested as described in Example 1. The tensile properties before and after treatment were:

| | T/E/Mi |
|---|---|
| Before | 29.4/5.3/518 |
| After | 31.3/5.4/540 |

This example illustrates the improvement in the tensile properties of an aramid fiber achieved by the present invention.

EXAMPLE 4

A sample of a fiber composed of the terephthalamide of p-aminobenzhydrazide was soaked for 20 hours in quinoline and then for 2 hours in quinoline at the boil and atmospheric pressure. A sample of the fiber was also treated with pyridine in the manner described in Example 1. In this instance the initial modulus increased from 496 to 575 grams per denier. The tensile properties of each treated fiber sample were determined and are compared below:

| | T/E/M | Work-to-Break |
|---|---|---|
| Quinoline treatment | 14.5/3.6/490 | 0.3382 |
| Pyridine treatment | 14.7/3.7/575 | 0.3530 |

EXAMPLE 5

The fibers of Examples 3 and 4 were each heated with pyridine in a bomb heated to and maintained at 125° C. for 2 hours. After the fibers were washed with water and dried, they were found to have even better tensile properties than those given in Examples 3 and 4. This example illustrates than in the case of all para-oriented fibers better penetration of the annealing media and further improvement of the fiber's tensile properties is attained by using superatmospheric rather than atmospheric pressure.

We claim:

1. A process for improving the tensile properties of aramid fibers which comprises treating said fiber with a liquid tertiary amine for at least 10 seconds, wherein said amine is maintained at a temperature of at least 80° C., but less than that temperature at which deterioration of said fiber occurs.

2. The process of claim 1 wherein the treating of said fiber is accomplished by soaking said fiber in a liquid tertiary amine bath.

3. The process of claim 2 wherein the tertiary amine is pyridine.

4. The process of claim 3 wherein said pyridine is maintained at a temperature between about 100° and 150° C.

5. The process of claim 3 wherein said fiber is composed of poly(p-phenylene terephthalamide).

6. The process of claim 3 wherein said fiber is composed of poly(m-phenylene isophthalamide).

7. The process of claim 3 wherein said fiber is composed of the polyterephthalamide of p-aminobenzhydrazide.

8. The process of claim 3 wherein said treating of said fiber is carried out using superatmospheric pressure.

9. The process of claim 4 wherein the fiber is soaked in the pyridine for a period of time ranging from about 30 to about 60 seconds.

* * * * *